US012753993B1

(12) United States Patent
Dabrowski et al.

(10) Patent No.: US 12,753,993 B1
(45) Date of Patent: Oct. 6, 2026

(54) OPTICAL TARGET IMAGING SYSTEM

(71) Applicant: U.S. Government as Represented by the Secretary of the Army, Picatinny Arsenal, NJ (US)

(72) Inventors: Krzysztof Dabrowski, Great Meadows, NJ (US); Robert P. Pinto, Dover, NJ (US); Maxwell D. DeLuca, Highland Lakes, NJ (US); Jason S. Current, Clark, NJ (US)

(73) Assignee: The United States of America as Represented by the Secretary of the Army, Washington, DC (US)

( * ) Notice: Subject to any disclaimer, the term of this patent is extended or adjusted under 35 U.S.C. 154(b) by 305 days.

(21) Appl. No.: 18/663,418

(22) Filed: May 14, 2024

(51) Int. Cl.
*F41G 3/32* (2006.01)

(52) U.S. Cl.
CPC ..... *F41G 3/323* (2013.01)

(58) Field of Classification Search
CPC . F41G 3/32; F41G 3/323; F41G 3/326; F41G 1/545; G01B 11/26; G01C 15/00
See application file for complete search history.

(56) References Cited

U.S. PATENT DOCUMENTS 1,994,177 A * 3/1935 Nolan ..... F41G 3/323 89/200
4,665,795 A * 5/1987 Carbonneau ..... F41G 3/323 356/139.08
4,676,636 A * 6/1987 Bridges ..... F41G 3/323 33/286
4,825,258 A * 4/1989 Whitson ..... F41G 1/54 33/286
5,413,028 A * 5/1995 Ng ..... F41G 3/323 89/41.09
7,665,218 B1 * 2/2010 Pinto ..... F41G 3/323 33/282
7,856,729 B1 * 12/2010 Pinto ..... F41G 5/26 33/286
10,739,109 B1 * 8/2020 Tello ..... F41G 3/08
2007/0009860 A1 * 1/2007 Young ..... F41G 3/326 434/21
2008/0003543 A1 * 1/2008 Varshneya ..... F41G 1/54 434/21
2013/0344461 A1 * 12/2013 Tello ..... F41G 3/2644 434/21
2020/0370869 A1 * 11/2020 Clermont ..... F41G 3/22
2026/0078983 A1 * 3/2026 Claeser ..... F41G 3/323

* cited by examiner

*Primary Examiner* — Joshua E Freeman
(74) *Attorney, Agent, or Firm* — David J. Torrente

(57) ABSTRACT

An optical target imaging system includes a tower structure supporting the system at the muzzle of the barrel, a cantilever system connected to and supported from the tower structure by a system of flexible tensioners extending in a distal direction from above an elevation of the muzzle to a distal end. A distal screen assembly is beneath the cantilever system at the distal end and holds a distal screen to intersect a path extending the barrel central axis. A proximal screen assembly holds a proximal screen to intersect the path extending the barrel central axis between the muzzle and the distal screen. In some embodiments, the distal screen is held with a lower extent nearer to the muzzle. The distal screen may be mounted to be rotatable around a median axle in the plane of the distal screen, with an actuator to articulate the distal screen around the median axle.

20 Claims, 8 Drawing Sheets

OPTICAL TARGET IMAGING SYSTEM

STATEMENT OF GOVERNMENT INTEREST

The inventions described herein may be manufactured, used and licensed by or for the United States Government.

BACKGROUND OF THE DISCLOSURE

Field of the Disclosure

The instant disclosure relates to the field of armaments, and more particularly to improvements in making precise cannon pointing measurements to verify that pointing accuracy requirements of particular weapon systems are being met.

Brief Description of Related Art

In mortar- and/or artillery-type projectile weapon systems, there is a need to verify that weapon-system pointing-accuracy requirements are being met. To do so, the ability to accurately, and independently, measure where the weapon is pointed is critical. Disclosed in U.S. Pat. No. 7,856,729 issued 28 Dec. 2010 to Pinto, et al. ("Pinto '729"), which is commonly assigned with the instant application, is a Bore Elevation and Azimuth Measuring Apparatus and Method, alternately known as the Bore Elevation and Azimuth Measuring System or "BEAMS". The complete disclosure of Pinto '729 is hereby incorporated by reference herein in its entirely for all purposes.

Referring to FIG. 7 (also FIG. 1 of Pinto '729), the BEAMS device 10 includes a centering mandrel 18 having a longitudinal axis B. Mounted on mandrel 18 are at least one, preferably at least two, lobe assemblies 22. Each lobe assembly 22 may include at least three lobes 24 arranged radially from the longitudinal axis B of the mandrel 18. The lobes 24 contact the interior bore wall and are dimensioned such that they center the mandrel 18 and align it with the bore axis C of bore 14 in tube 12. Preferably, the second lobe assembly 22 is included at a location that is axially displaced from the first lobe assembly 22 to thereby maintain the axis B of the mandrel 18 coaxial with the bore axis C.

A support member 36 is fixed at one end 38 to the centering mandrel 18 and at another end 40 to a laser 42. The longitudinal axis of the support member 36 is substantially coaxial or coincident with the longitudinal axis B of the centering mandrel 18. In one embodiment, the end 40 of support member 36 may include a threaded portion that threads into an opening (not shown) in the base of laser 42. The laser 42 is made to illuminate a surface at two separate locations. Two optical instruments, for example, theodolites T1, T2, are situated so they may directly view the first laser spot where it strikes the first location (H), the second laser spot where it strikes a surface at the second location (M), and also each other.

The locations of the two respective laser spots are an extension of the bore centerline C. The optical instruments, e.g., theodolites T1 and T2, are preferably at two different elevations, and are referenced to level horizon and also to a known azimuth reference, for example north. The relative angular measurements among and between T1, T2 and the two laser spots can describe the orientation of the tube 12 in three-dimensional space.

The BEAMS device 10 has certain drawbacks, particularly in an outdoor environment. To aid in implementing the BEAMS device 10, a device to observe the laser spot(s) was created. Specifically, a fixture was created that attached to either or both of the mandrel 18 and/or the tube 12, and extended out some distance therefrom. The fixture included two screens, one nearer to and another father from the muzzle of the cannon. A draw string allowed an operator to swing the near screen out of the path of the laser, thereby allowing the laser to illuminate the far screen.

Although effective for certain smaller weapon systems, the fixture had limitations. Such a fixture, constructed in a single piece from welded steel, was unwieldy when scaled up for application to a larger weapon platform, for example the M119 Howitzer, having a 105 mm bore, 30.5 caliber cannon barrel, and varieties of M777 towed howitzer, and/or M109 self-propelled howitzer, each of the latter having a 39-caliber cannon barrel with 155 mm bore. The size and weight of the measurement fixture interfered with the normal movement of the cannon. The length of both the fixture and the cannon made it necessary for a separate person to operate the draw string that articulates the screen. Indeed, as many as three operators were required to make the necessary measurements. Additionally, the fixture was difficult to ship to alternate operating locations as needed, again owing to size and weight. In some instances, elements of the fixture itself interfered with the view of the laser spot from the optical instruments. This required stopping the measurement process and reorienting the fixture to provide clear line of sight between the optical instruments and the laser spot before continuing.

Accordingly, there is an unmet need in the art for a pointing accuracy verification system that is lightweight. There is an unmet need in the art for a pointing accuracy verification system that is structurally stable to operate during cannon-pointing articulation at its full speed. There is an unmet need in the art for a pointing accuracy verification system with improved usability, for example having remotely adjustable screens and which does not obstruct view of the screens from ground level. There is an unmet need in the art for a pointing accuracy verification system that is easy to assemble, disassemble, and transport. There is an unmet need in the art for a pointing accuracy verification system that is operable with numerous caliber cannon systems for pointing accuracy measurements in conjunction with a BEAMS system or another optical pointing accuracy measurement system.

BRIEF SUMMARY OF THE DISCLOSURE

In order to overcome these and other short comings in the known art, provided according to the present disclosure is an optical target imaging system for a weapon system firing from a barrel with a central axis, the barrel terminating at a muzzle. The optical target imaging system includes a tower structure supporting the system at the muzzle of the barrel and extending generally vertically upward therefrom, and a cantilever system connected to and supported by the tower structure extending in a distal direction from above an elevation of the muzzle to a distal end. In certain embodiments, the cantilever system is supported from the tower structure by a system of flexible tensioners.

A distal screen assembly is supported beneath the cantilever system at the distal end which holds a second distal screen to intersect a path extending the barrel central axis. In certain embodiments, the distal screen assembly is removably attached to the cantilever system. The distal screen assembly may be attached to the cantilever system via one or more removable spacer blocks. A proximal screen assembly holds a proximal screen to intersect the path extending the barrel central axis at a point between the muzzle and the distal screen. In certain embodiments, the distal screen and/or the proximal screen is translucent to laser light.

According to one embodiment of the present disclosure, the proximal screen assembly has an actuator configured and operative to articulate the proximal screen out of the path extending the barrel central axis. In a particular embodiment, the proximal screen assembly holds the proximal screen with a lower extent of the proximal screen nearer to the muzzle than an upper extent of the proximal screen. According to another embodiment of the present disclosure, the distal screen is held with a lower extent of the distal screen nearer to the muzzle than an upper extent of the distal screen.

In another embodiment of the present disclosure, the distal screen is mounted on a second distal screen frame. The distal screen frame is connected to the distal screen assembly to be rotatable around a first axis that lies in the plane of the distal screen frame. The distal screen assembly includes an actuator configured and operative to articulate the distal screen to rotate around the first axis. In a certain embodiment, the actuator is configured and operative to articulate the distal screen around the first axis in both directions from a neutral position generally transverse to the path extending the barrel central axis. The actuator may be embodied as a rotary motor connected to the distal screen frame by a system of linkages that converts the unidirectional rotary motion of the rotary motor to an oscillatory motion of the distal screen frame. The actuator and system of linkages may optionally be configured and operative to articulate the distal screen frame through a range of rotation of at least about ±65° from the neutral position.

It is also part of the present disclosure that the cantilever system comprises a plurality of parallel pairs of extension segments with one or more lateral clamps holding each member of each parallel pair of extension segments in parallel, and further holding each parallel pair of extension segments axially adjacent to another pair of extension segments. A distal beam is provided at the distal end of the cantilever system. In a particular embodiment, the one or more lateral clamps are configured and operative to form an electrically conductive path from one parallel pair of extension segments to an axially adjacent parallel pair of extension segments, while the one or more lateral clamps are configured and operative to electrically insulate each member of each parallel pair of extension segments from the lateral counterpart extension segment.

It is also part of the present disclosure to provide an anchor removably secured to the barrel proximally from the muzzle and having a connection point for anchoring one or more tensioners from the tower structure. The location of the anchor along the barrel is selected to provide the one or more tensioners forming an angle of between about 20° and about 70° with a top of the tower structure.

In certain embodiments, the optical target imaging system includes a core tube sized to fit within the bore of the barrel, and at least one bore collar inserted into the bore of the barrel having an outer diameter thereof sized to match an inner diameter of the barrel.

Disclosed according to the present disclosure is an optical target imaging system for a weapon system firing from a barrel having a central axis, the barrel terminating at a muzzle, the optical target imaging system comprising a distal screen assembly supported from above at a distal end of the system, the distal screen assembly holding a distal screen to intersect a path extending the barrel central axis. The distal screen is held with a lower extent of the distal screen being nearer to the muzzle than an upper extent of the distal screen. The distal screen is mounted on a distal screen frame connected to the distal screen assembly to be rotatable around a first axis that lies in the plane of the distal screen frame. The distal screen assembly includes an actuator configured and operative to articulate the distal screen to rotate around the first axis. The actuator is preferably configured and operative to articulate the distal screen around the first axis in both directions from a neutral position generally transverse to the path extending the barrel central axis.

In certain embodiments of an optical target imaging system, the actuator is a rotary motor connected to the distal screen frame by a system of linkages that converts the unidirectional rotary motion of the rotary motor to an oscillatory motion of the distal screen frame. The actuator and system of linkages is optionally configured and operative to articulate the distal screen frame through a range of rotation of at least about ±65° from the neutral position.

BRIEF DESCRIPTION OF DRAWINGS

These and other features, benefits, and advantages of the present disclosure will be made apparent with reference to the following detailed description, appended claims, and accompanying figures, wherein like reference numerals refer to like structures across the several views, and wherein:

It will be noted that, although particular sizes, dimensions and/or calibers are discussed at certain points herein with respect to exemplary embodiments of Applicant's present disclosure, the drawings are not necessarily to scale.

DETAILED DESCRIPTION OF THE DISCLOSURE

Figure 1:
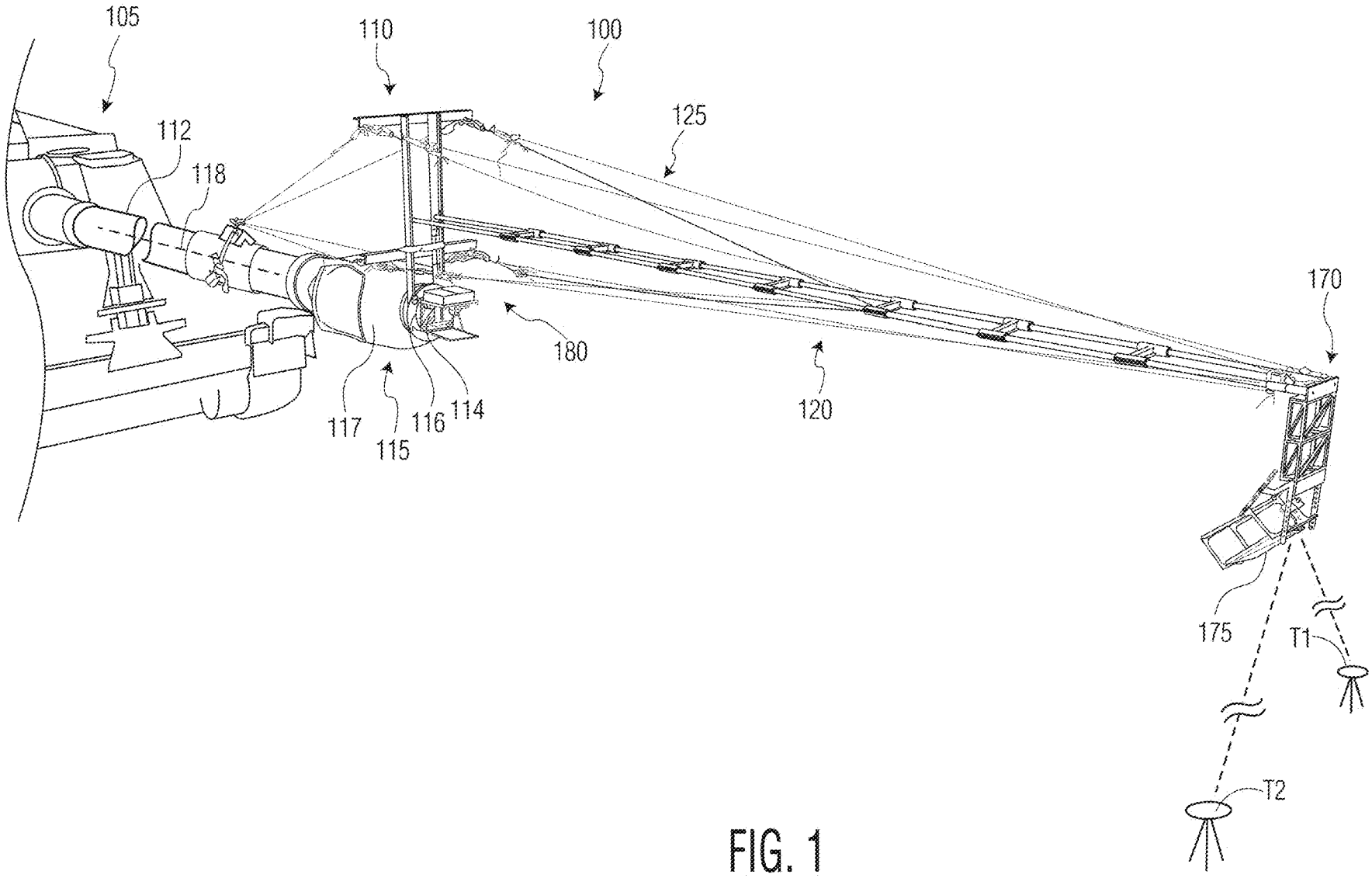
FIG. 1 illustrates a perspective view of an Optical Target Imaging System in accordance with the present disclosure mounted to a turreted, self-propelled howitzer.

Referring now to FIG. 1, illustrated is a perspective view of an Optical Target Imaging System ("OTIS"), generally 100, in accordance with the present disclosure. In this exemplary embodiment, the OTIS 100 is mounted to a turreted, self-propelled howitzer 105, for example one of the M109 family. The cannon 112 of self-propelled howitzer 105 will have a bore 114. In the particular case of the M109 family, the bore 114 is sized at 155 mm diameter, and the cannon 112 is 39 caliber, i.e., its length is 39 times its bore, specifically 6.045 m. The bore 114 of cannon 112 will have a defining longitudinally extending bore axis 118. It will be understood by those skilled in the art that the instant disclosure is not limited to this or any particular size or apparatus. For example, the system 100 can be made to work with larger or smaller self-propelled artillery, towed artillery, and/or mortar systems, virtually any tube-launched weapon system.

The system 100 is generally comprised of two major subsystems. The first of these subsystems is the support tower 110. The support tower 110 is proximal to the self-propelled howitzer 105 and mounts the system 100 to the cannon 112, generally at or near the muzzle 115 and particularly the exit opening 116 of a muzzle brake 117 if the cannon 112 is provided with one. The second major subsystem is a so-called "ladder", generally 120. The ladder subsystem 120 extends from the support tower 110 in a cantilever fashion in a distal direction from the muzzle 115. The ladder subsystem 120 is supported from the support tower 110 via a system of tensioners 125.

Figure 2:
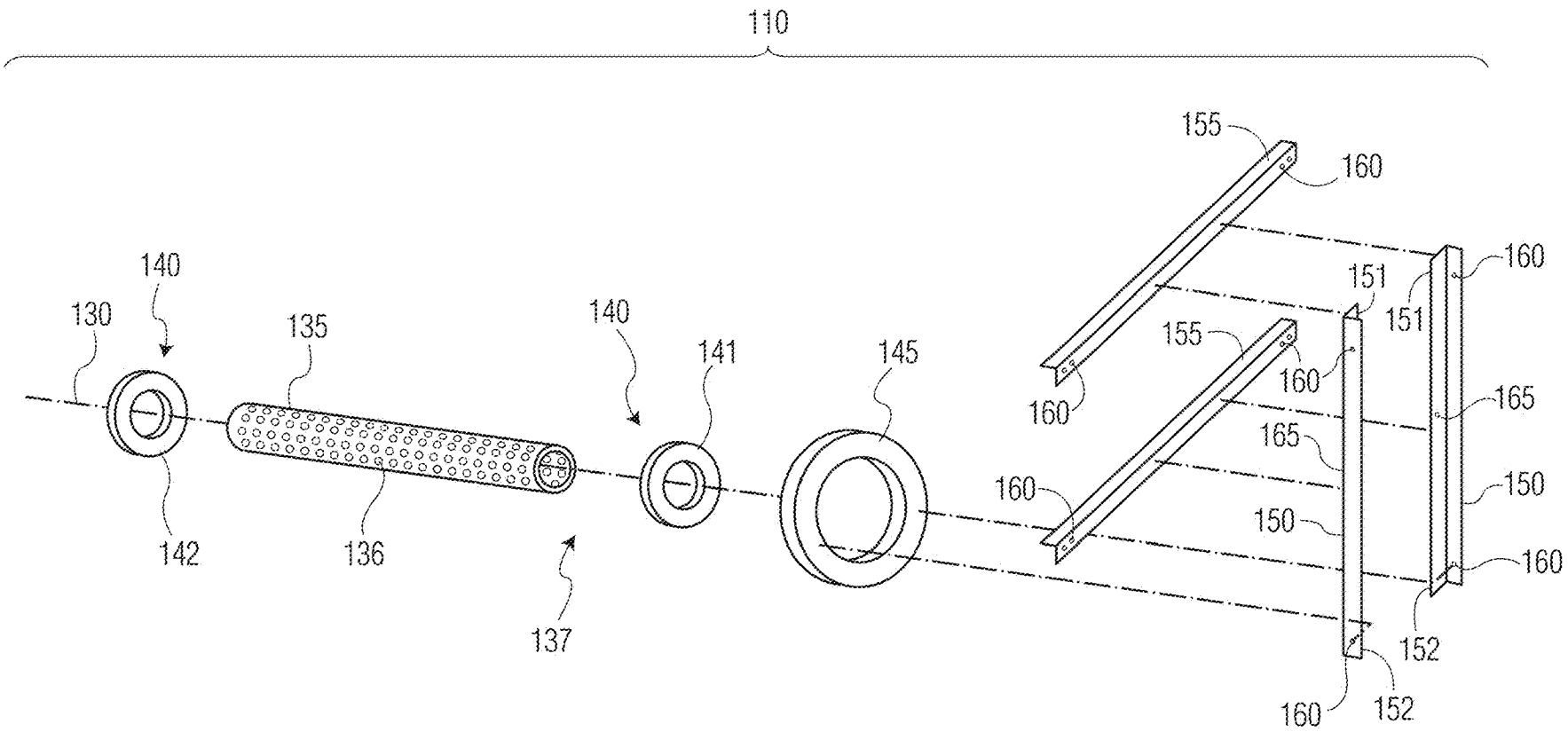
FIG. 2 illustrates an exploded assembly view of the support tower of the Optical Target Imaging System.

Referring now to FIG. 2, illustrated is the support tower 110 in an exploded assembly view along a central axis 130. The support tower 110 is based upon a core tube 135, coaxial with central axis 130. The core tube 135 is sized to be inserted into the bore 114 of the cannon 112 past the muzzle 115. In certain particular embodiments, the core tube 135 includes systematic perforations 136, which provide for weight reduction, inter alia. The core tube 135 is fitted with at least one bore collar 140, but more preferably a plurality of bore collars 140, including at least a distal bore collar 141 and a proximal bore collar 142. The bore collars 140 each have an outer diameter which matches either the bore 114 of cannon 112, or the exit opening 116 of the muzzle 115. Accordingly, the one or more bore collars 140 make full contact with the cannon 112 and use the cannon 112 to support the support tower 110. The distal bore collar 141 and the proximal bore collar 142 are preferably spaced apart from one another along the central axis 130. Based on the size and intended location of the bore collars 140, this serves to align the central axis 130 coaxially with the bore axis 118.

A flange 145 is affixed at the distal end 137 of the core tube 135. In those embodiments where the distal bore collar 141 has an outside diameter to fit within the bore 114 itself, the flange 145 acts to limit the depth of insertion of the core tube 135 into the cannon 112. In other embodiments, the distal bore collar 141 fits within the exit opening 116 of the muzzle 115 and/or of the muzzle brake 117, such that the inner diameter of the exit opening 116 is greater than the bore 114 of the cannon 112, and the distal bore collar 141 can be considered part of the flange 145 to the extent that it, too, acts to limit the depth of insertion of the core tube 135 into the cannon 112.

Vertical beams 150 are secured to the flange 145 on either lateral side of the exit opening 116 and extend generally upward therefrom. The vertical beams 150 are secured to at least one, and in certain embodiments plural, lateral beam(s) 155. The ends of the vertical beams 150 and/or the one or more lateral beams 155 may each be provided with attachments 160 to receive the tensioners 125. In a simple embodiment, attachment 160 is a through hole. In more particular embodiments the attachments 160 may comprise one or more of an eye bolt, eye hook, and eye nut. The specifics of the system of tensioners 125 is described in further detail below.

Also along the length of the vertical beams 150 is a point of attachment 165 to the ladder subsystem 120. The ladder subsystem 120 attaches to the support tower 110 above the central axis 130. The ladder subsystem 120 extends distally outward from the support tower 110 in a cantilever fashion, as indicated by centerline 122 (See, FIG. 3). A first proximal screen assembly 180 is supported closer to the exit opening 116, and includes a first proximal screen 182. The first proximal screen assembly 180 can be mounted to the ladder subsystem 120, or directly to the support tower 110. The distal end 170 of the ladder subsystem 120 supports a second distal screen assembly 175, having a second distal screen 177.

Figure 3:
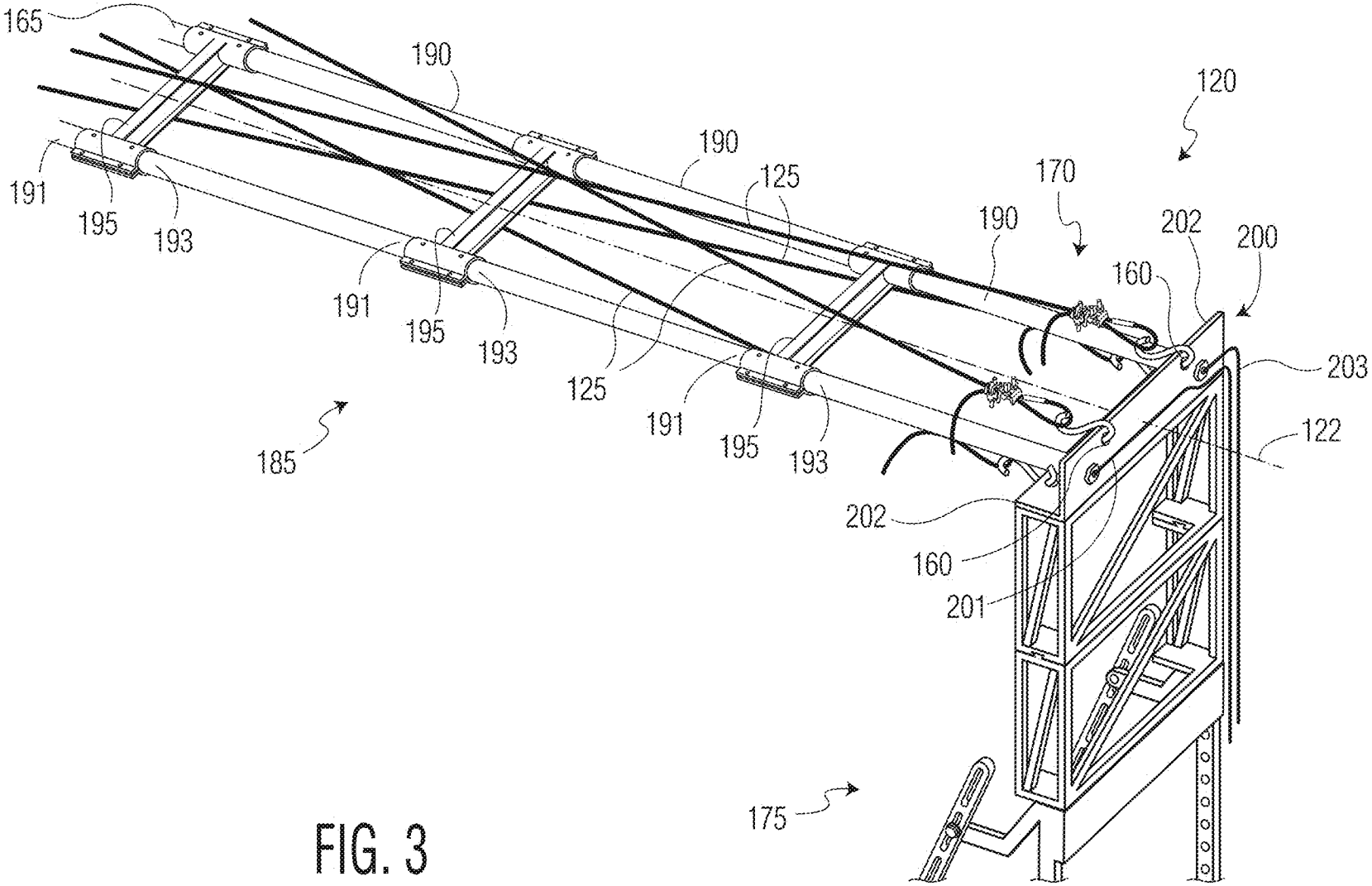
FIG. 3 illustrates a perspective view of the ladder subsystem of the Optical Target Imaging System.

Referring now to FIG. 3, illustrated is the ladder subsystem 120, distally from the point of attachment 165. In one exemplary embodiment, the ladder subsystem 120 includes a cantilever structure 185. The cantilever structure 185 is comprised of a plurality of extension segments 190. The extension segments 190 are secured end-to-end, at least in part, by joint clamps 195, to extend in a longitudinal direction and also laterally to an adjacent series of segments 190. In an alternate embodiment, the extension segments 190 may be each provided with a complementary mating end pair comprising a male end 191 that fits to a female end 193.

At the distal end 170, the adjacent series of segments 190 are connected to one another by a distal end beam 200. The distal end beam 200 also serves as a point of attachment to hold the second distal screen assembly 175. Distal end beam 200 is also provided with attachments 160 at either lateral end 202, which are a point of attachment for tensioners 125. For improved stability of the ladder subsystem 120, which aids in the accuracy of measurement, the tensioners 125 running from either side of the distal end beam 200 will be connected to the support tower 110. The tensioners 125 terminate at attachments 160. In a particular embodiment, the tensioners 125 terminate both above and below the level of the point of attachment 165, and also mutually cross centerline 122.

It is noted that, according to the particular embodiment described above, the length of the cantilever structure 185 is modular in nature. More segments 190 and clamps 195 may be added to extend the distal end 170 farther from the cannon 112. This may be done to make the overall OTIS 100 operable with different sizes, calibers, and/or bore of weapon system. Additionally, increasing the distance of the distal screen 175 from the proximal screen 180 will improve the accuracy of the overall measurements by making the inter-screen distance greater, and thus less prone to being affected by measurement error. This is not without cost or tradeoff, however. For example, additional weight of the ladder subsystem 120 and the increased distance to the distal end 170 will place a greater strain on the tensioners 125, and make articulating the cannon 112 to take multiple measurements for redundancy and reduction of error more difficult and time-consuming, among other drawbacks. The decision of exactly how many segments 190 to use for any given weapon system will be within the discretion of the user of ordinary skill in the art, in light of the instant disclosure.

Figure 4:
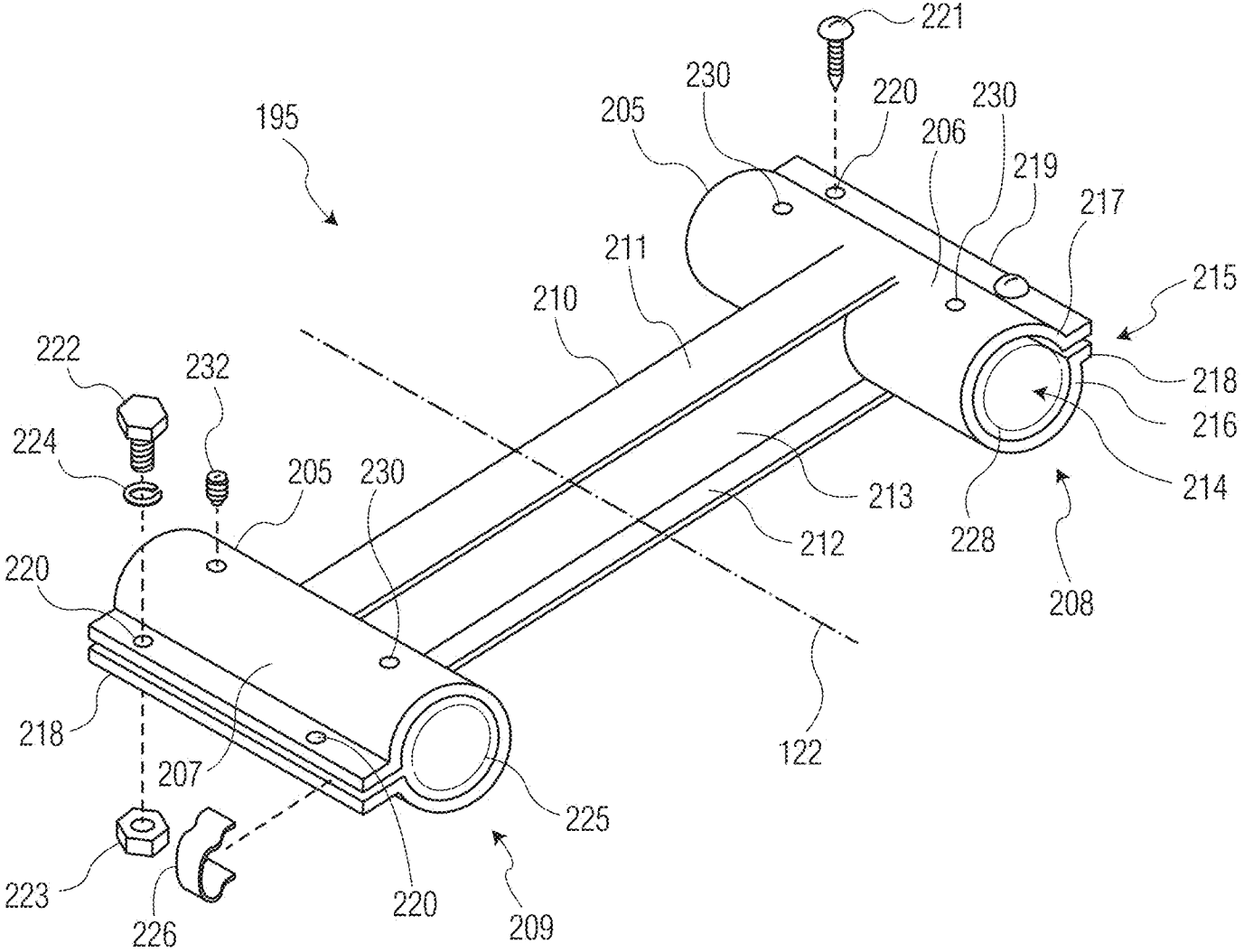
FIG. 4 illustrates a perspective view of a joint clamp of the ladder subsystem.

Referring now to FIG. 4, illustrated is a perspective view of a joint clamp 195. In use, the joint clamp 195 will be oriented as indicated by the longitudinal centerline 122. The joint clamp 195 features a generally cylindrical clamping bracket 205 on either lateral end. To the extent that is it necessary to distinguish between the lateral sides of the bracket 195, and presuming the centerline 122 is generally aligned with the forward direction of the self-propelled howitzer 105, the terms left and right are adopted consistent with the self-propelled howitzer 105. Therefore, a first left side clamp 206 would be on a left end 208 of bracket 195. A second right side clamp 207 would be on a right end 209 of bracket 195. The left side clamp 206 and the right side clamp 207 are connected with one another via spacer beam 210. In the exemplary embodiment, spacer beam 210 has a longitudinal cross-sectional profile of a roman capital letter "I"-shaped beam, including horizontally disposed flanges 211, 212 forming a respective top and bottom of the spacer beam 210. Flanges 211, 212 are connected with one another by a web 213. In the depicted orientation, the web 213 is vertical. Other profile shapes may be apparent to those of skill in the art, taking into consideration factors such as rigidity to resist deflection and bending under the expected or actual loads applied, and the volume, density and weight of the material comprising the spacer beam 210.

In the present embodiment, each clamping bracket 205 is formed as a "C"-shaped channel 214, with a longitudinal opening 215. The channel 214 all but completely encircles the cylindrical extension segments 190 that would be inserted therein upon assembly. Each open end 216, 217 of the channel 214 has a respective flange 218, 219 extending radially outward therefrom. The flanges 218, 219 serve as place to clamp the channel 214, as onto an extension segment 190 inserted therein. To aid in this, flanges 218, 219 may be provided with complementary through holes 220 to receive and hold some variety of fastener, e.g., screw 221, nut 223 & bolt 222 combination, spring clip 226, or the like. In an alternate embodiment, the channel 214 may have plural threaded holes 230 provided therein, preferably at least distally and proximally for each clamping bracket 205. Holes 230 receive respective set screws 232. Tightening the set screws 232 secures the extension segments 190 within the clamping bracket 205. In those embodiments securing the extension segments 190 by set screws 232, the clamping bracket 205 need not be split along opening 215.

In still other embodiments, the extension members 190 need not be round in cross-sectional profile. The clamping bracket 205 may be any nominal shape to mate with and accept the extension segments 190. Moreover, the profile shape of clamping bracket 205 and segments 190 need not be identical, if they are nonetheless compatible. For example, a round or C-channel clamping bracket 205 may adequately engage and hold an octagonal or hexagonal profile extension member 190, whether through closing flanges 218, 219, or set screws 232.

Upon assembly, each clamping bracket 205 receives a pair of extension segments 190, one each from a distal side and a proximal side, inserted into the channel 214. In certain embodiments, the distal and proximal extension segments 190 are preferably abutted with one another, and more preferably create a path for electrical conductivity from one segment 190 into a longitudinally adjacent segment. In certain embodiments, the clamping brackets 205 further include an electrically conductive sleeve 225. The conductive sleeve 225 is positioned to contact both extension segments 190 inserted into the clamping bracket 205, i.e., from both the distal and proximal side thereof. Regardless of the means by which the clamping bracket 205 is configured to secure the extension segments 190 within the channel 214, the conductive sleeve 225 will be pressed into contact with both the distal and proximal extension segments 190, ensuring a path of electrical conductivity from one extension segment 190 to a longitudinally adjacent extension segment 190. In certain embodiments of the ladder subsystem 120, electrical conductivity through the extension segments can be provided and/or enhanced by the interface of the male end 191 and female end 193 of adjacent extension segments 190. This conductivity path enables a more particular embodiment of the system 100, as described hereinafter.

Figure 5A:
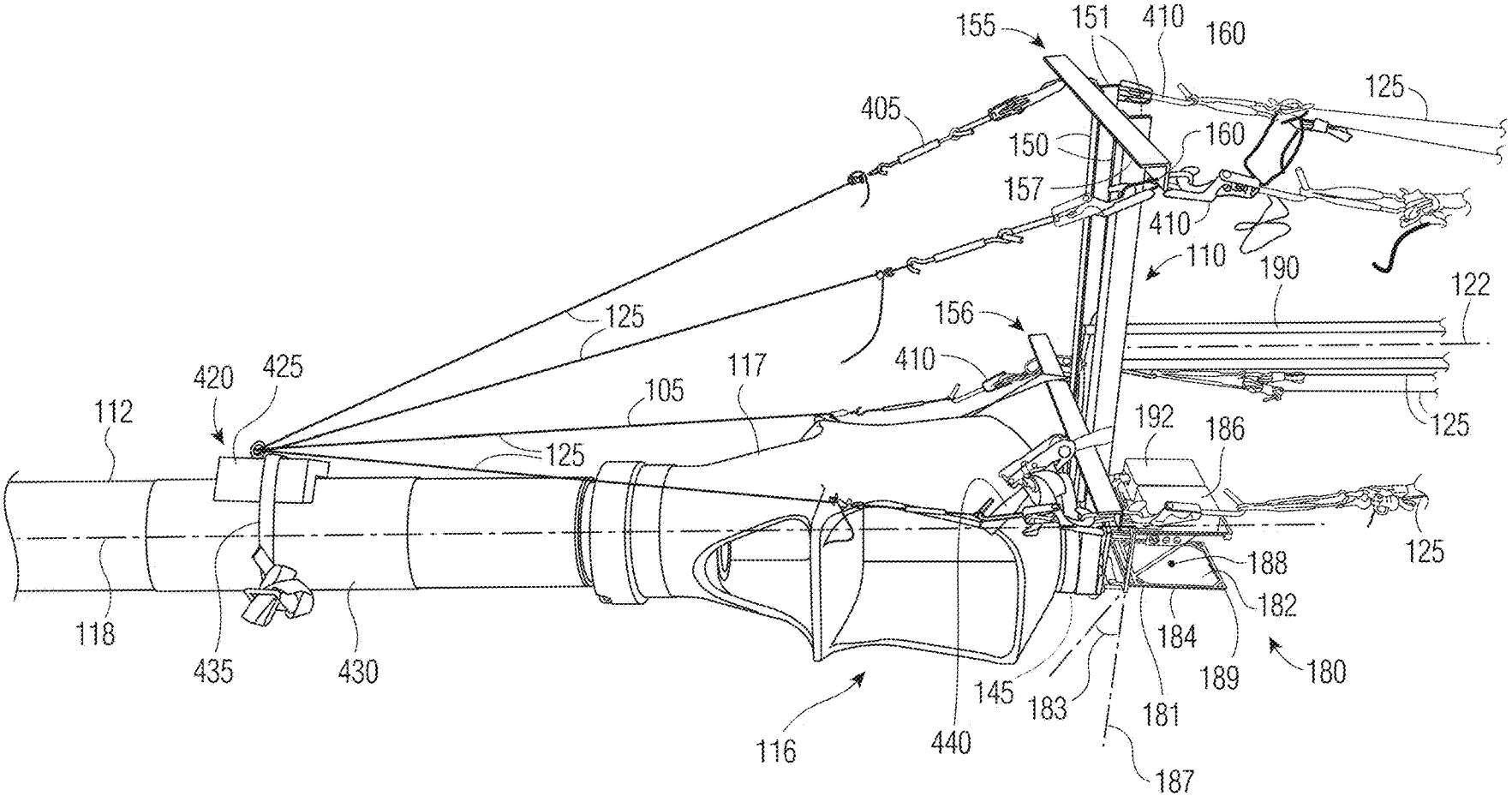
FIG. 5A illustrates a perspective view of the support tower installed into the exit opening of a cannon provided with a muzzle brake.

Referring now to FIG. 5A, illustrated is the support tower 110 installed into the exit opening 116 of a cannon 112 provided with a muzzle brake 117. In the depicted embodiment, first proximal screen assembly 180 is disposed distally to the flange 145, near or adjacent to it. The first proximal screen assembly 180 includes the first proximal screen 182 mounted on a first proximal frame 184, and an actuator 186 operative to articulate the first proximal frame 184.

The actuator 186 places the first proximal screen 182 in the path of the beam produced by, e.g., a BEAMS device 10 and/or a laser 42 thereof. Therefore, the beam of the laser 42 is permitted to strike the first proximal screen and illuminates a proximal point 188 at a proximal location (H) that lies on the extended bore axis 118 of the cannon 112. In a particular embodiment, the first proximal screen 182 is preferably translucent to the laser 42, such as a translucent mylar film. Accordingly, the beam of the laser 42 striking the first proximal screen 182 from a proximal side at proximal location (H) creates a proximal point 188 that is visible from the distal side, e.g., the position of theodolites T1, T2.

After the angular measurements are taken among and between theodolites T1, T2 and the proximal point 188, the actuator 186 articulates the first proximal frame 184 to move the first proximal screen 182 out of the path of the laser 42. Thus, the beam of the laser 42 has a clear path and can fully illuminate a distal point 307 on the second distal screen 177 at distal location (M).

In the presently disclosed embodiment, it is found convenient to co-locate power and control hardware 192 with the first proximal screen assembly 180. Among other benefits, reducing the weight of the distal end 170, as compared with co-locating the power and control hardware as part of the second distal screen assembly 175, makes the system 100 easier to maneuver with the movements of the cannon 112. The first proximal screen assembly 180 is also nearer to operator, and nearer to the ground. Power and control hardware 192 may include a power source or supply, driving, e.g., actuator 186 and actuator 325. The power for the actuators may also be derived from the self-propelled howitzer 105, as available. Power and control hardware 192 may also control the operation of, e.g., actuator 186 and actuator 325. It would also be convenient to have a remote user interface (not shown) to interface with power and control hardware 192.

As already noted, in use of the system 100 the cannon 112 is articulated through a range of motion, in both elevation and azimuth. In the process of collecting barrel position data, the optical instruments, e.g., theodolites T1, T2, are located distally from the cannon 112 (see FIG. 1). Second distal screen 177 and first proximal screen 182 serve as targets to visualize and thereby measure the extension of the extended bore axis 118. With the second distal screen 177 and first proximal screen 182 mounted nominally vertically, raising the elevation of the cannon 112 would place the first proximal screen 182 and second distal screen 177 at an oblique angle to the theodolites T1, T2, in at least the vertical plane. This limits the view of the screens 177, 182 from the theodolites T1, T2.

To overcome this obliqueness in the vertical plane, according to a more particular embodiment of the present disclosure, the first proximal screen 182 is held at an angle 183 to a local and nominal vertical 187. The local and nominal vertical is defined as generally aligned with a longitudinal axis of the vertical beams 150. Specifically, the first proximal screen 182 is held relative to the vertical 187 such that a lower end 181 of the screen 182 is nearer to the flange 145 than an upper end 189 of the screen 182.

Therefore, as the cannon 112 is raised, the first proximal screen 182 is more closely aligned with a normal or perpendicular orientation to the theodolites T1, T2, and the first proximal screen 182 presents a larger visual target to the-odolites T1, T2, which is easier to acquire and measure.

The support tower 110 is secured to the cannon 112 at a removable anchor 425 placed along the length of the barrel at an anchor point 420 proximal to the muzzle 115 and particularly the exit opening 116 of a muzzle brake 117 if the cannon 112 is provided with one. Because the removable anchor 425 is removable, the precise location of anchor point 420 can be chosen by the skilled artisan, in light of the instant disclosure. The system 100 is designed to be interoperable with multiple weapon platforms, and thus the distance from the support tower 110 to the removable anchor 425 and anchor point 420 may change from one platform to another. Among the factors to be considered are the angle that the tensioners 125 make with the vertical beams 150 as secured between the attachments 160 and the removable anchor 425. In certain embodiments, this angle is within a range of about 20-70° from the vertical beams 150.

In one embodiment, a protective layer 430 is placed over the cannon 112, and in more particular embodiments may encircle the circumference of the cannon 112, at the anchor point 420 where the anchor 425 is to be secured. The protective layer 430 may comprise corrugated cardboard, closed cell foam or the like. The removable anchor 425 may be placed over the protective layer 430 and secured to the cannon 112 by a frictional device, e.g., a tightened ratchet strap 435. The removable anchor 425 is specifically designed to yield to application pressure, e.g., by the ratchet strap 435, before any damage or malformation is applied to the cannon 112.

In an exemplary embodiment, the removable anchor includes two generally flat wood sections joined at a right angle to one another in the form of a V-block. The included right angle is placed facing the cannon 112 overlying the protective layer 430, and is thereafter secured to the cannon 112 by the ratchet strap 435. Either the wood itself or the right-angle joint and/or any fasteners joining the parts of the anchor 425 will fail under the ratchet strap 435 well before the ratchet strap 435 reaches a tightness that could potentially do any damage to the cannon 112. In a still further embodiment, an additional ratchet strap 440 is provided to secure the support tower 110 in position and upright at the muzzle brake 117, if available.

Figure 5B:
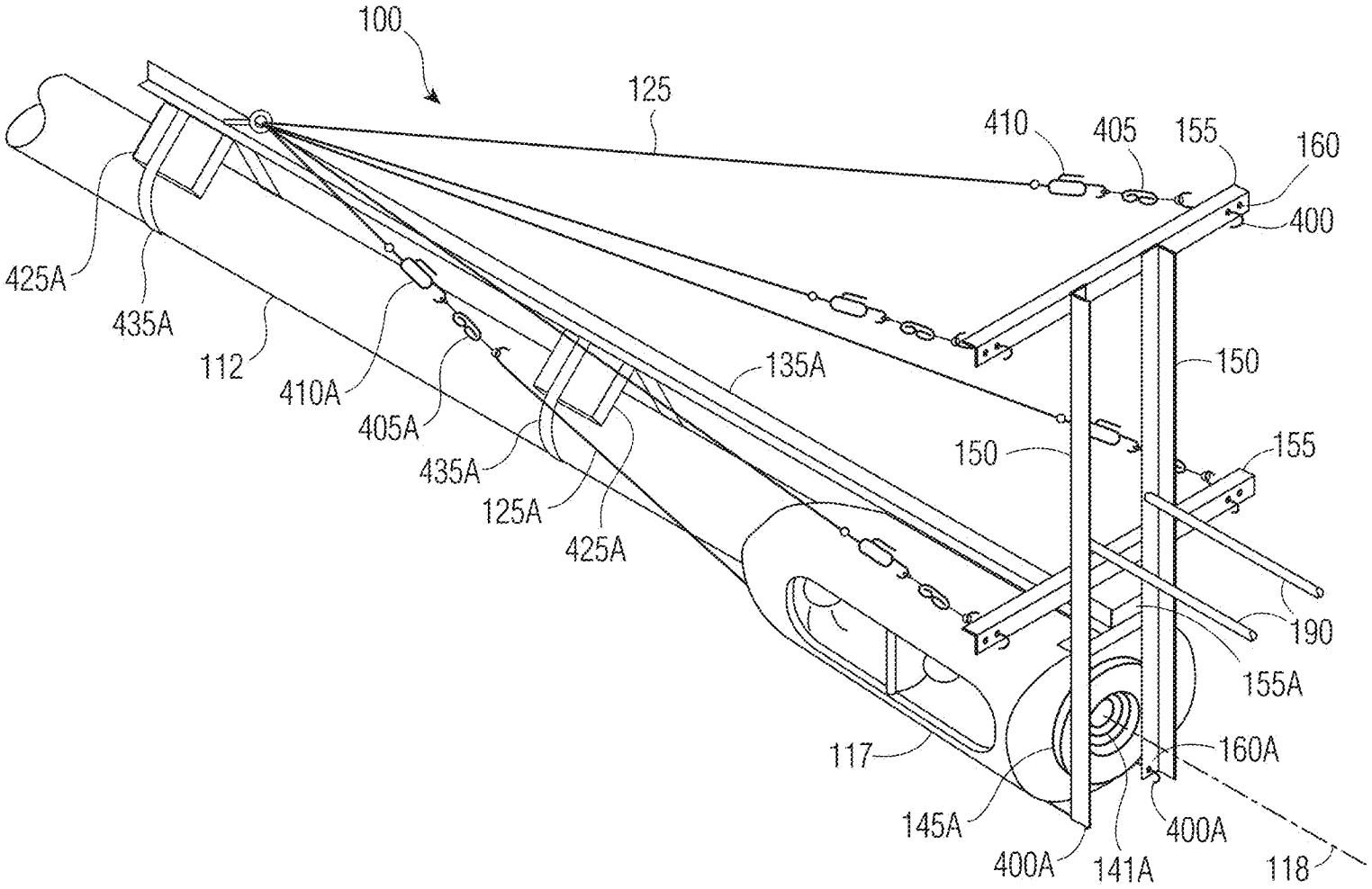
FIG. 5B illustrates a perspective view of an alternative embodiment in which system, and particularly its support tower, are connected with the self-propelled howitzer by interfacing to the exterior surface of the cannon.

Referring now to FIG. 5B, illustrated is an alternative embodiment in which system 100, is positioned atop cannon 112. Vertical beams 150 along with the components that they support, are secured to a horizontal support structure consisting of a lateral beam 155A, longitudinal beam 135A, and a plurality of removable anchors 425A placed along the length of the barrel. The removable anchors 425A are secured to the cannon 112 by a frictional device, e.g., a tightened ratchet strap 435A. The precise location of where removable anchors 425A are affixed to the longitudinal beam 135A along its length, and relative to the muzzle 115 and muzzle brake 117 if the cannon 112 is provided with one, can be chosen by the skilled artisan, in light of the instant disclosure.

A flange 145A is affixed between the two vertical beams 150 at a position that when system 100 is placed atop the cannon 112, the flange 145A, with an appropriately sized bore collar 141A, if required, fits within the exit opening 116 of the muzzle 115 and/or of the muzzle brake 117, centering the flange 145A on the longitudinally extended bore axis 118.

At the lower end of each vertical beam 150 is attachment point 160A to receive the tensioners 125A with associated turnbuckle 405A or other such hardware to facilitate length adjustment, as well as quick-release latch 410A, so that tensioner lengths can be pre-set, and released for quick disassembly, and reattached for just as quick reassembly. Tensioners 125A attach to the proximal removable anchor 425A at the same point as the proximal tensioners 125 previously described, to balance the forces acting along vertical beams 150 from the tensioners 125 above the attachment point of lateral beam 155A. Tensioners 125A may wrap around the sides of cannon 112 to reach a removable anchor 425A at the top of the cannon, or may be secured to a separate removable anchor on the lower side of the cannon as chosen by the skilled artisan, in light of the instant disclosure.

Figure 6:
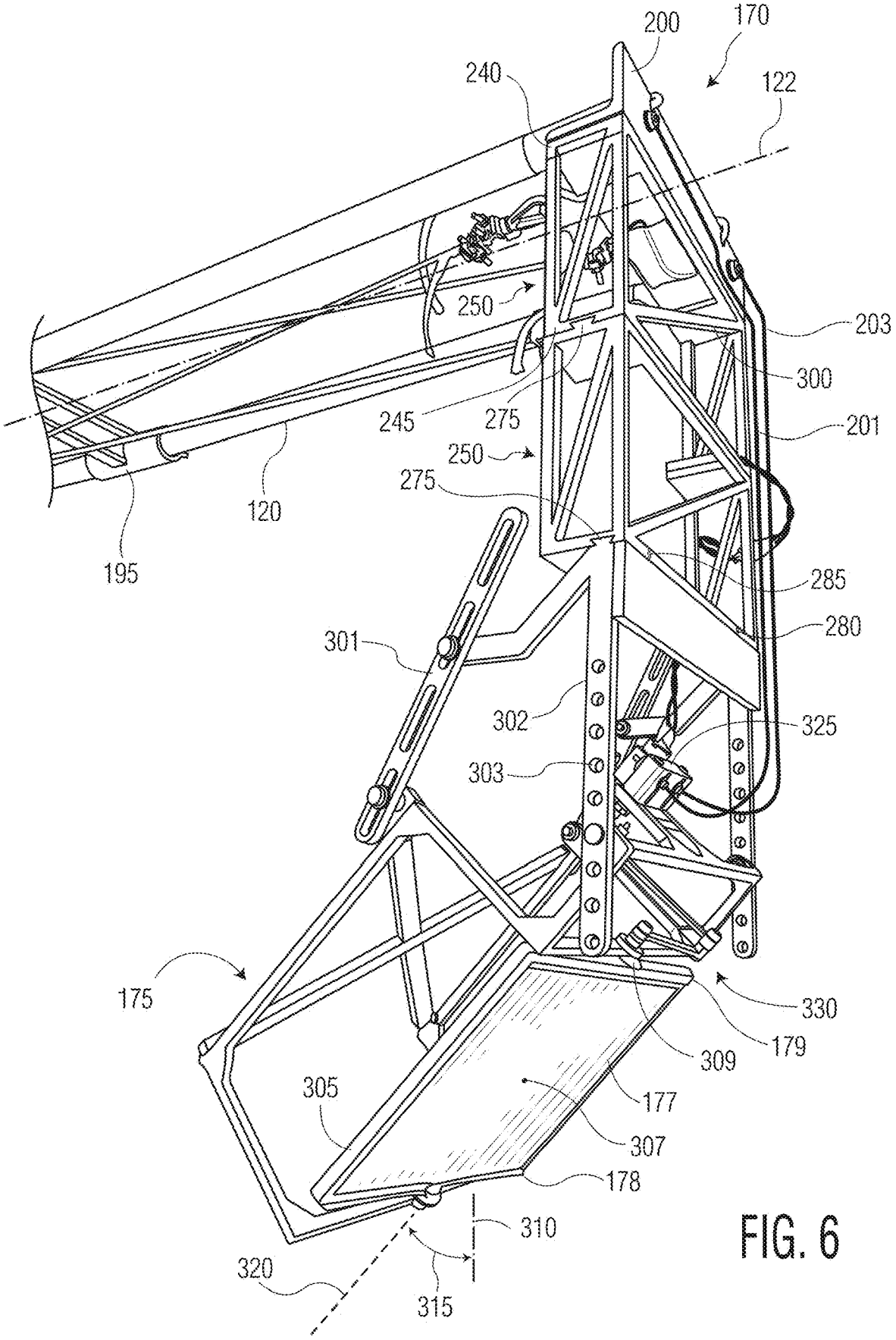
FIG. 6 illustrates a perspective view of the distal end of the ladder subsystem.
Figure 7:
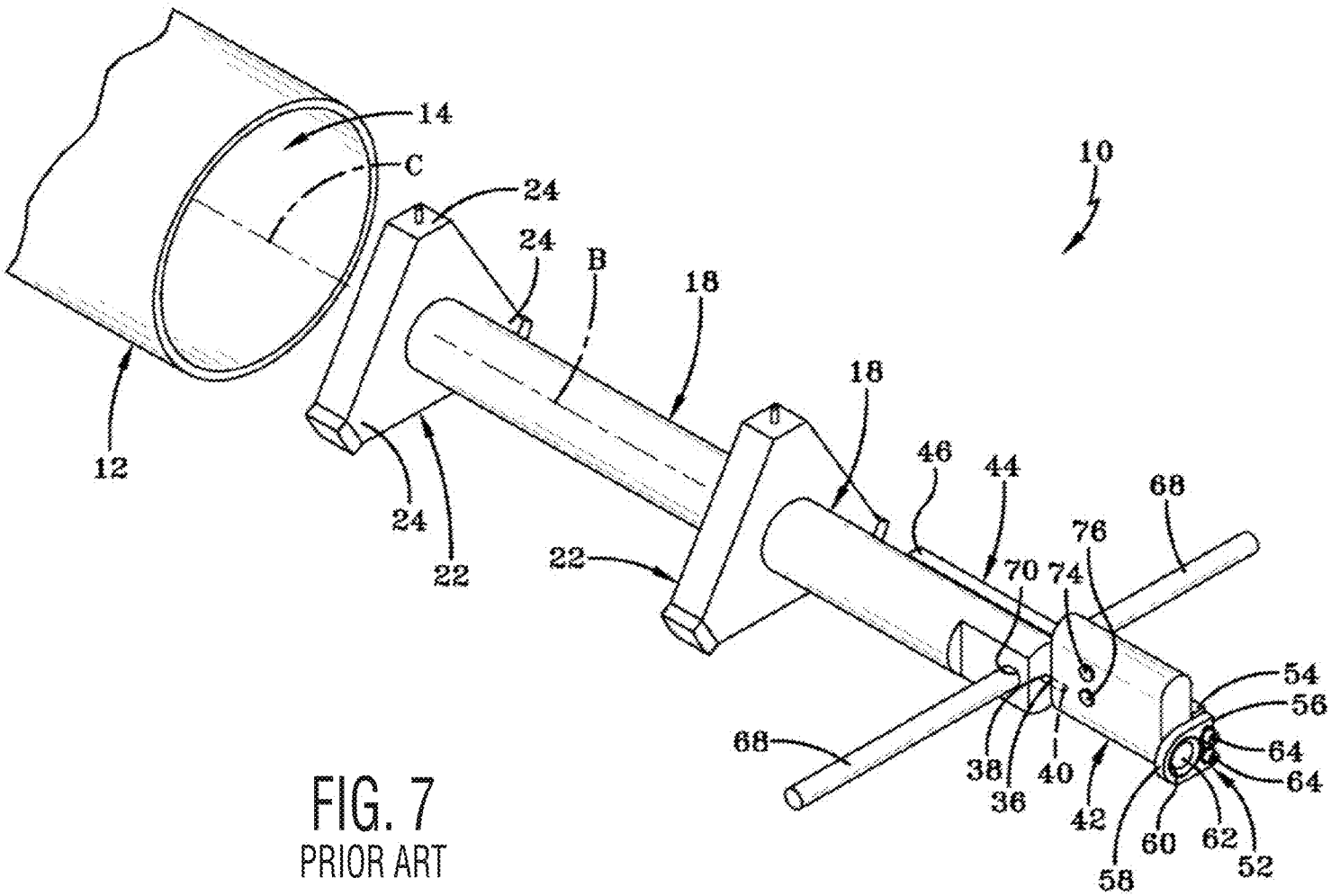
FIG. 7 PRIOR ART
FIG. 7 illustrates a perspective view of a centering mandrel as used in the Bore Elevation and Azimuth Measuring System according to the prior art.

Referring now to FIG. 6, illustrated is a perspective view of the distal end 170 of the ladder subsystem 120, and more particularly the second distal screen assembly 175. The second distal screen assembly 175 is mounted to distal end beam 200. In a particular embodiment, the distal end beam 200 is provided on an underside thereof with a mounting bracket 240. The mounting bracket 240 can include a dovetail slot 245 oriented to face downward therefrom. A top bracket 300 of the second distal screen assembly 175 can include a dovetail tab 275 oriented to face upward.

The dovetail tab 275 is sized and configured to slide into and thereby mate with dovetail slot 245, vertically connecting the second distal screen assembly 175 to the distal end beam 200. The dovetail tab 275 may be fixed laterally in the dovetail slot 245, in one embodiment by a set screw 280 secured within the threaded hole 285. In a more particular embodiment, the second distal screen assembly 175 may optionally be spaced from the distal end beam 200 by one or more modular spacer brackets 250. A spacer bracket 250 can include a dovetail tab 275 oriented facing upward, and a dovetail slot 245 oriented facing downward. The spacer bracket 250 can likewise include a threaded hole 285 and complementary set screw 280 to laterally secure the dovetail tab 275 in the dovetail slot 245. Maintaining one or more spacer brackets 250 makes the system 100 interoperable with different weapon platforms by making the height of the second distal screen 177 adjustable with more or fewer spacer brackets 250.

The second distal screen assembly 175 holds the second distal screen 177, on a screen frame 305, and places the second distal screen 177 in the path of the beam produced by, e.g., a BEAMS device 10 and/or a laser 42 thereof. Therefore, the beam of the laser 42 is permitted to strike the second distal screen 177 and illuminates a distal point 307 at a distal location (M) that lies on the extended bore axis 118 of the cannon 112. In a particular embodiment, the second distal screen 177 is preferably translucent to the laser 42, such as a translucent mylar film. Accordingly, the beam of the laser 42 striking the second distal screen 177 from a proximal side at distal location (M) creates a distal point 307 visible from a distal side, i.e., the position of theodolites T1, T2.

In use of the system 100, the cannon 112 is run through a range of motion, in both elevation and azimuth. This allows the collection of multiple iterations of barrel position data, at least in part to verify proper cannon 112 pointing over the howitzer's 105 full range of elevation and traverse. In the process of collecting barrel position data, the optical instruments, e.g., theodolites T1, T2, are located distally from the cannon 112 (see FIG. 1). With the second distal screen 177 mounted nominally vertically, raising the cannon 112 would place the second distal screen 177 at an oblique angle to the theodolites T1, T2, in at least the vertical plane. This limits the view of the distal point 307 from the theodolites T1, T2.

To overcome this obliqueness in the vertical plane, according to a more particular embodiment of the present disclosure, the second distal screen 177 is held at an angle 315 relative to a vertical 310. The vertical 310 is defined by a downward direction from the distal end beam 200, substantially perpendicular with the ladder subsystem 120. Specifically, the second distal screen 177 is held relative to the vertical 310 such that a lower end 178 of the screen 177 is nearer to the support tower 110 than an upper end 179 of the screen 177. Therefore, as the self-propelled howitzer 105 raises the cannon 112, the second distal screen 177 is more closely aligned with a normal or perpendicular orientation to the theodolites T1, T2, and the second distal screen 177 presents a larger visual target to theodolites T1, T2, which is easier to acquire and measure.

More preferably, the second distal screen 177 and/or the second distal screen assembly 175 is adjustably attached to the distal beam 200, enabling the angle 315 to be preset and/or adjusted. For example, the connection of the second distal screen 177 and/or the second distal screen assembly 175 to the mounting bracket 240 can include one or more slotted members 301, and/or connecting members 302 having one or more selectable holes 303 for pivotal attachment. In a further embodiment of the present disclosure, a spring 309, more preferably a spring 309 having a relatively low spring-constant, is installed between the screen frame 305 and the stationary portion of distal screen assembly 175. The spring 309 may include a torsion spring around axle 320, or an extension spring. Spring 309 exerts a force in on screen frame 305, thus preventing it from fluttering or shifting position in the wind due to clearance in the plural-bar oscillation linkage 330 and/or backlash in actuator 325.

A difficulty arises with regard to the lateral movement of the cannon 112, and particularly the second distal screen assembly 175. As the cannon 112, and to a greater extent the second distal screen assembly 175, is moved in azimuth towards the direction of a first theodolite (i.e., T1), the second distal screen 177 presents a laterally oblique angle to the counterpart theodolite T2. The same is true in the opposite direction, mutatis mutandis. It would therefore be advantageous that the second distal screen 177 presented a larger target to either or both theodolites T1, T2, by the angle between the second distal screen 177 and the theodolites T1, T2, to be close to normal (i.e., perpendicular). In this case, because the cannon 112 moves laterally in both directions, it would be beneficial for the second distal screen 177 to likewise pivot laterally in both directions.

Therefore, in accordance with still a further embodiment of the present disclosure, the second distal screen 177 is mounted to a screen frame 305 which is configured to be articulated around a median axle 320. The median axle 320 lies in the plane of the screen frame 305, which is itself at angle 315 with respect to vertical 310. The median axle 320 of the screen frame 305 is selected to cross generally vertically through the extended bore axis 118 as nearly as practicable. In doing this, the distal point 307 created on the second distal screen 177 will not appreciably move in space during the oscillation of the screen frame 305.

The articulation of the screen frame 305 can be controlled by an actuator 325, in the exemplary embodiment a rotary motor, and more particularly a DC motor. In a more detailed embodiment, the actuator 325 selected is a gear motor, and even more specifically one having a worm gear output. The worm gear can provide several advantages, at least one of which is the anti-backlash characteristics of the worm gear arrangement. Accordingly, when the worm gear output motor is stopped, it can act as a brake on the screen frame. The actuator 325 is mounted to the top of the second distal screen assembly 175. The one-way rotary motion of the actuator 325 can be attached to a plural-bar oscillation linkage 330 to effect the alternate lateral oscillation of the screen frame 305. In a particular embodiment, the second distal screen 177 oscillates at least about ±30° laterally. In a more particular embodiment, the second distal screen 177 oscillates at least about ±45° laterally. In a still more particular embodiment, the second distal screen 177 oscillates at least about ±65° laterally.

It will be appreciated that, in use, the distal end 170 of the system 100 will often be several meters above ground level, and swing several more meters from left to right as the cannon 112 articulates through its measurement range. Accordingly, any articulation of the second distal screen 177 is preferably remote and more preferably autonomous. In the embodiment described above, the bilateral oscillation of the screen 177 is carried out by the linkage 330 and one way rotary motion of the actuator 325. In certain embodiments, the actuator 325 and thus the oscillation, can be controlled by controlling the flow of electrical power. In order to deliver electrical power to the distal end 170 of the ladder subassembly 120, and more particularly to the actuator 325, it is described herein that the extension segments 190, though their connection by and at joint clamps 195 can form two independent serially electrically conductive paths. Accordingly, the ladder subsystem 120 serves as both structural, and control functions in the OTIS 100.

Referring briefly back to FIG. 6, the extension segments 190 terminate at the distal beam 200. Conductors 201, 203, are conductively connected with respective left and right extension segments 190, and deliver, in one embodiment, DC power to actuator 325 implemented as a DC motor. In other embodiments, the actuator 325 may be implemented as a single-phase AC motor, with conductors 201, 203, via the independent serially electrically conductive paths of extension segments 190 providing single-phase AC power.

The lateral obliqueness described above with respect to second distal screen 177 as viewed from theodolites T1, T2 is also applicable, to a certain extent, to the first proximal screen 182. However, it is less of a difficulty, in part because the first proximal screen 182 is closer to the center of rotation of the cannon 112 than the second distal screen 177. Therefore, the first proximal screen 182 does not move nor rotate as far laterally with the azimuth rotation of the cannon 112 as compared to second distal screen 177. Also, the theodolites T1, T2 are closer to the second distal screen 177 than to the first proximal screen 182, meaning that the viewing angle between the theodolites T1, T2 and the second distal screen 177 is more impacted by the lateral movement of the second distal screen 177. This is to say that, while it is possible, and within the scope of the present disclosure, to apply to the second distal screen assembly 180 a lateral oscillation mechanism analogous to the actuator 325 and related components that is described in an embodiment of the second distal screen assembly 175, it may also be omitted from the first proximal screen assembly 180, for example to make the system 100 simpler, lighter, having fewer points of failure, among other reasons, without substantially degrading the performance of the system 100 as a whole.

The support tower 110 and ladder subsystem 120 are held together, both respectively and to one another, and in their desired orientation by a system of flexible tensioners 125. The various tensioners 125 run between one or more attachments 160 on the support tower, particularly at the ends 151, 152, of the vertical beams 150 and of the lateral beams 155 making up the support tower 110. Attachments 160 may also be provided in the distal end 170, for example at both lateral ends. Depending upon the size and load of the ladder subsystem 120, additional tensioners 125 may connect the cantilever structure 185 with the support tower 110 at one or more points along the length of the cantilever structure 185.

The attachments 160 may be through holes provided in the respective beams. Alternately, they may be an eye secured to the beams by appropriate means. The tensioners 125 may be terminated at the attachments 160 in certain embodiments by s-hooks 400 or the like. In some instances, the tensioners 125 may be configured to pass through the attachments 160 to provide support in multiple directions. The tensioners 125 may further include turnbuckles 405 or other such hardware to facilitate length adjustment. In a still further embodiment, the tensioners 125 may be provided with quick-release latches 410, so that tensioner lengths can be pre-set, and released for quick disassembly, and reattached for just as quick reassembly.

Flexible metal cable is one material choice for tensioners 125, e.g., one-eighth (0.125) inch braided stainless steel. However, eighth-inch braided stainless, among most any other metal cabling in the appropriate load class, exhibits considerable stretching under load. While this can be overcome with some combination of turnbuckles 405 or other length-adjusting hardware, in a more particular embodiment the tensioners 125 are comprised of stretch-resistant polymer-based braided cord, e.g., nylon-based paracord, aramid-base cord (i.e., KEVLAR, inter alia), and/or UHMW polyethylene-based fiber cord (i.e., SPECTRA). The latter two of these among those mentioned is particularly resistant to elongation under load.

It is noted that many of the components that make up the support tower 110, and the ladder subsystem 120 are Commercial Off-The-Shelf (i.e., "COTS" and/or "OTS") components, making the system 100 very economical to construct. For example, the core tube 135 may be a length 4" diameter PVC pipe. Likewise, the flange 145 may be a COTS PVC part used for any variety of purposes. The vertical beams 150 and/or lateral beams 155 may be made constructed from angle or profile channel aluminum, both of which are readily available in any number of shapes and sizes, and being aluminum are reduced in weight as compared to, e.g., steel. Extension segments 190 may be readily available 18-in. aluminum poles, so-called "tent poles". The actuator 325 for oscillating the second distal screen 177 may be a simple OTS DC motor. Tensioners 125 as KEVLAR or SPECTRA cord and hardware such as s-hooks 400 and turnbuckles 405, inter alia, are all readily available commercially in a variety of configurations. Certain parts such as the bore collar 140, and/or joint clamps 195, that are not commercially available may be nonetheless readily, rapidly and cost-efficiently fabricated, e.g., by 3D printing.

The present disclosure has been described herein with reference to certain exemplary and/or preferred embodiments. These embodiments are offered as merely illustrative, and not limiting, of the scope of the present disclosure. Certain alterations or modifications may be apparent to those skilled in the art, in light of instant disclosure, without departing from the spirit or scope thereof. The full scope of Applicant's invention is defined solely with reference to the following appended claims.

The invention claimed is:

1. An optical target imaging system for a weapon system firing from a barrel with a central axis, the barrel terminating at a muzzle, the target imaging system comprising:

a tower structure supporting the system at the muzzle of the barrel and extending generally vertically upward therefrom;

a cantilever system connected to and supported by the tower structure, the cantilever system extending in a distal direction from above an elevation of the muzzle to a distal end;

a first proximal screen assembly holding a first proximal screen to intersect a path extending the barrel central axis at a first point distal to the muzzle of the barrel; and a second distal screen assembly supported beneath the cantilever system at the distal end, the second distal screen assembly holding a second distal screen to intersect the path extending the barrel central axis at a second point distal to the first point.

2. The optical target imaging system according to claim 1, wherein the first proximal screen is translucent to laser light.

3. The optical target imaging system according to claim 1, wherein the first proximal screen assembly has an actuator configured and operative to articulate the first proximal screen out of the path extending the barrel central axis.

4. The optical target imaging system according to claim 1, the first proximal screen assembly holding the first proximal screen with a lower extent of the first proximal screen is nearer to the muzzle than an upper extent of the first proximal screen.

5. The optical target imaging system according to claim 1, wherein the cantilever system is supported from the tower structure by a system of flexible tensioners.

6. The optical target imaging system according to claim 1, wherein the second distal screen assembly is removably attached to the cantilever system.

7. The optical target imaging system according to claim 6, wherein the second distal screen assembly is attached to the cantilever system via one or more removable spacer blocks.

8. The optical target imaging system according to claim 1, wherein the second distal screen is held with a lower extent of the second distal screen is nearer to the muzzle than an upper extent of the second distal screen.

9. The optical target imaging system according to claim 1, wherein the second distal screen is mounted on a second distal screen frame;

the second distal screen frame is connected to the second distal screen assembly to be rotatable around a first axis that lies in a plane of the second distal screen frame; and the second distal screen assembly includes an actuator configured and operative to articulate the second distal screen to rotate around the first axis.

10. The optical target imaging system according to claim 9, wherein the actuator is configured and operative to articulate the second distal screen around the first axis in two directions from a neutral position in which the second distal screen is generally transverse to the path extending the barrel central axis.

11. The optical target imaging system according to claim 9, wherein the actuator is a rotary motor connected to the second distal screen frame by a system of linkages that converts the unidirectional rotary motion of the rotary motor to an oscillatory motion of the second distal screen frame.

12. The optical target imaging system according to claim 1, wherein the cantilever system comprises a plurality of parallel pairs of extension segments;

one or more lateral clamps holding each extension segment in parallel with a lateral counterpart extension segment, and further holding each parallel pair of extension segments axially adjacent to another pair of extension segments; and a distal beam at the distal end of the cantilever system.

13. The optical target imaging system according to claim 12, wherein the cantilever system forms an electrically conductive path from each extension segment to an axially adjacent extension segment; and the one or more lateral clamps are configured and operative to electrically insulate each member of each parallel pair of extension segments from the lateral counterpart extension segment.

14. The optical target imaging system according to claim 1, further comprising:

a first anchor configured to be removably secured to the barrel proximally from the muzzle and having a connection point for anchoring one or more tensioners from the tower structure.

15. The optical target imaging system according to claim 14, further comprising:

a second anchor configured to be removably secured to the barrel at a longitudinally distant position from the first anchor; and a beam lying longitudinally with the barrel connecting the first and second anchors with each other, and both with the tower structure.

16. The optical target imaging system according to claim 1, further comprising a core tube sized to fit within the bore of the barrel, and at least one bore collar inserted into the bore of the barrel having an outer diameter thereof sized to match an inner diameter of the barrel.

17. An optical target imaging system for a weapon system firing from a barrel having a central axis, the barrel terminating at a muzzle, the target imaging system comprising:

a distal screen assembly supported from above at a distal end of the system, the distal screen assembly holding a distal screen to intersect a path extending the barrel central axis;

the distal screen being held with a lower extent of the distal screen nearer to the muzzle than an upper extent of the distal screen;

the distal screen is mounted on a distal screen frame;

the distal screen frame is connected to the distal screen assembly to be rotatable around a first axis that lies in the plane of the distal screen frame; and the distal screen assembly includes an actuator configured and operative to articulate the distal screen to rotate around the first axis.

18. The optical target imaging system according to claim 17, wherein the actuator is configured and operative to articulate the distal screen around the first axis in both directions from a neutral position in which the distal screen is generally transverse to the path extending the barrel central axis.

19. The optical target imaging system according to claim 18, wherein the actuator and system of linkages is configured and operative to articulate the second distal screen frame through a range of rotation of at least about ±65° from the neutral position.

20. The optical target imaging system according to claim 17, wherein the actuator is a rotary motor connected to the second distal screen frame by a system of linkages that converts a unidirectional rotary motion of the rotary motor to an oscillatory motion of the second distal screen frame.

* * * * *